United States Patent [19]

Ignasiak

[11] 4,259,083

[45] Mar. 31, 1981

[54] PRODUCTION OF METALLURGICAL COKE FROM OXIDIZED CAKING COAL

[75] Inventor: Boleslaw Ignasiak, Edmonton, Canada

[73] Assignee: Alberta Research Council, Edmonton, Canada

[21] Appl. No.: 22,807

[22] Filed: Mar. 22, 1979

[51] Int. Cl.[3] ..... C10L 9/06; C10B 57/02

[52] U.S. Cl. ..... 44/1 F; 201/24

[58] Field of Search ..... 44/1 F, 10 C, 1 R; 201/24

[56] References Cited

U.S. PATENT DOCUMENTS

| | | | |
|---|---|---|---|
| 2,338,634 | 1/1944 | Fuchs | 44/1 R |
| 2,359,581 | 10/1944 | Porter | 201/24 |
| 3,357,896 | 12/1967 | Gasior et al. | 44/1 R |
| 3,883,399 | 5/1975 | Nire | 201/24 X |

FOREIGN PATENT DOCUMENTS

| | | | |
|---|---|---|---|
| 186085 | 9/1922 | United Kingdom | 201/24 |
| 228686 | 2/1925 | United Kingdom | 201/24 |
| 1002654 | 8/1965 | United Kingdom | 44/10 R |

*Primary Examiner*—Carl F. Dees

*Attorney, Agent, or Firm*—Max L. Wymore

[57] ABSTRACT

A three step process is provided for producing high strength metallurgical coke from high volatile caking coals. Firstly, the caking coal is oxidized by heating the coal in an oxygen-containing atmosphere for a period of time. Secondly, the oxidized caking coal is blended with fresh or relatively non-oxidized caking coal. Thirdly, the blend is carbonized to yield metallurgical grade coke.

4 Claims, 4 Drawing Figures

INFLUENCE OF OXIDATION OF #3 COAL ON STRENGTH OF DERIVED COKES

A. OXIDATION IN OXYGEN AT 200°C
B. OXIDATION WITH AIR AT 150°C
C. OXIDATION WITH AIR AT 100°C

STRENGTH OF COKES PRODUCED FROM CHARGES COMPRISING #3 COAL BLENDED, IN INDICATED RATIOS, WITH THE SAME COAL OXIDIZED TO COMPLETE DISAPPEARANCE OF AGGLUTINATING PROPERTIES.

A. OXIDATION WITH OXYGEN, AT 200°C, FOR 2.5 HRS.
B. OXIDATION WITH AIR, AT 150°C, FOR 22 HRS.
C. OXIDATION WITH AIR, AT 100°C, FOR 407 HRS.

SCHEME OF SET-UP FOR PREHEATING OF 500-P COAL CHARGES

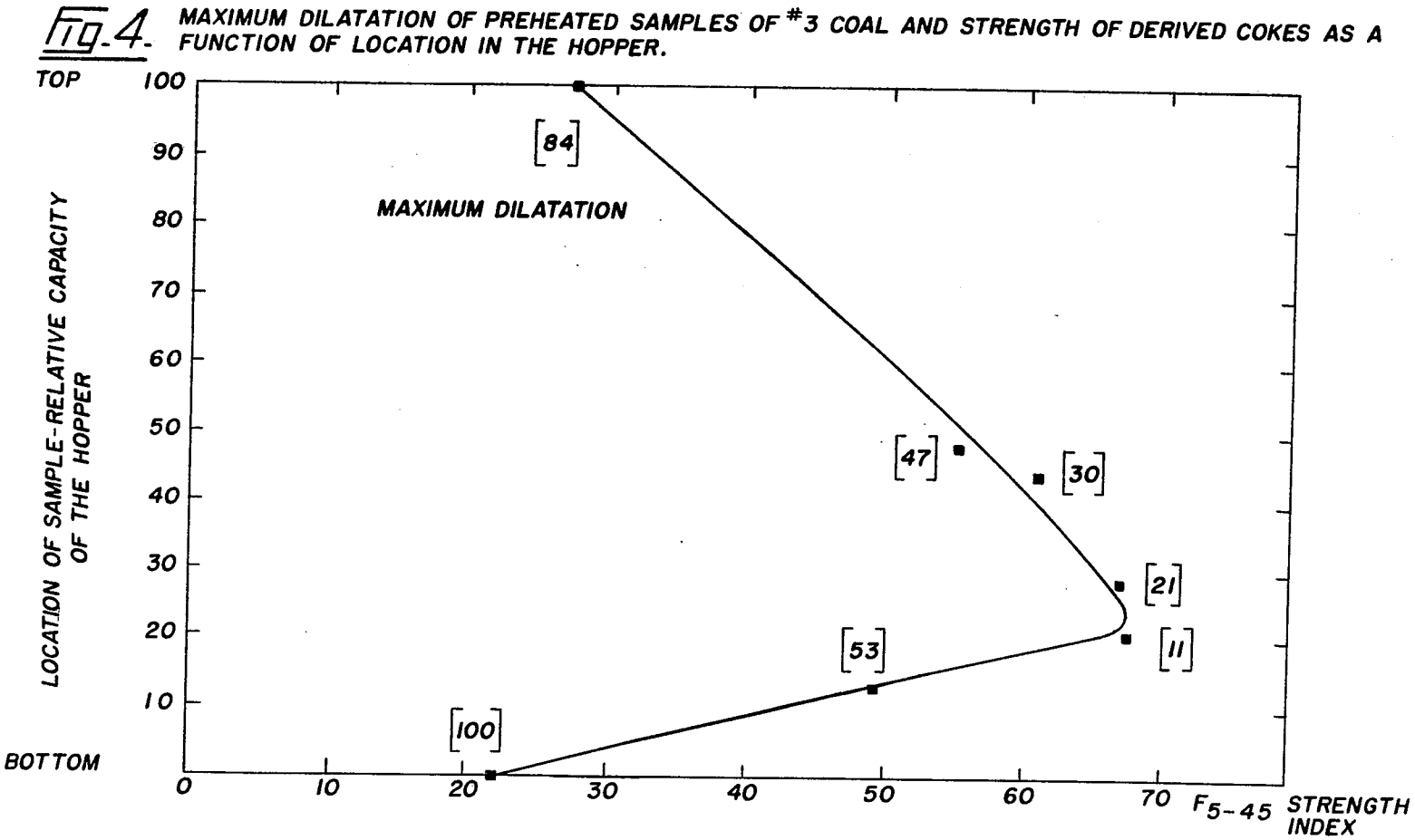
FIG. 4. MAXIMUM DILATATION OF PREHEATED SAMPLES OF #3 COAL AND STRENGTH OF DERIVED COKES AS A FUNCTION OF LOCATION IN THE HOPPER.

PRODUCTION OF METALLURGICAL COKE FROM OXIDIZED CAKING COAL

BACKGROUND OF THE INVENTION

The present invention relates to a process for producing metallurgical coke from high volatile caking coal.

Metallurgical cokes are high quality blast furnace or foundry cokes characterized by relatively high strength and stability. These cokes are routinely formed by a high temperature carbonization of bituminous coal blends. A typical blend is composed of high volatile, highly caking bituminous coals, hereinafter referred to as "caking coals", and medium and/or low volatile bituminous coals, hereinafter referred to as "coking coals".

Presently caking coals account for approximately 80% of the world's known reserves of Carboniferous coals (see Fisher, A.D., Metallurgical Coals for the Future; Proc. of 23rd Canadian Conference on Coal, Ottawa, Canada, pp 45–68, September, 1971). Many coal-producing countries are rich in their supply of caking coals, but possess an inadequate quantity of coking coals for the metallurgical blends. Heretofore, it has been necessary to blend caking and coking coals in order to obtain the high strength necessary in a metallurgical coke. At the present state of the art, caking coals alone, when carbonized, produce a coke having an inadequate strength. It is not feasible to use coking coals alone to manufacture a metallurgical coke because of their scarcity, relative high costs, and particularly due to the high expansion pressure exerted on the walls of a coke oven during carbonization.

Thus there is a need for a feasible process for producing coke, usable as metallurgical coke, from caking coals.

Previous workers have observed a minute increase in the strength of metallurgical cokes manufactured from some charges which have been preheated to temperatures of about 300° C. prior to carbonization. This increase in strength has been attributed to the removal of water during the preheating step (e.g. see Beck, K.B., Requirements of Coking Coals and How They are Affected by the Technical Development of Pig Iron and Blast Furnace Coke Production; 25th Canadian Conference on Coal, Victoria, September, 1973). A problem associated with this pre-heating treatment is the difficulty in obtaining a fast and uniform pre-heating of such large quantities of coal. Additionally there is a possibility of coal dust explosions resulting from the necessity of charging the coke oven with the hot pre-heated coal. Finally there are difficulties involved in transporting the coal between the pre-heater and the coke oven. These problems and difficulties appear to have prevented pre-heating from being applied commercially.

SUMMARY OF THE INVENTION

In accordance with the present invention it has been discovered that a caking coal, when exposed at elevated temperatures to an oxygen containing atmosphere, can yield on carbonization a stronger coke. It has also been found that therre is an optimum range of oxidation levels of the caking coal which will yield on carbonization a coke having the high strength necessary in a metallurgical coke.

It is difficult to uniformly oxidize caking coal to the optimum level previously mentioned. To overcome this difficulty, we have found that a first portion of caking coal, which has been oxidized but without achieving homogeneity of oxidation, may be blended with a second portion of non-oxidized caking coal to produce a mixture which, when later carbonized, yields a metallurgical-grade coke. This blending step is a , preferred feature of the invention.

The invention thus provides a process for producing a metallurgical coke from oxidized caking coals or from blends of oxidized and fresh caking coals, thereby eliminating or reducing the need for the scarce and expensive coking coal component. Since the average level of oxidation need only be at least in the optimal range of oxidation levels, the oxidation step does not require critical and elaborate control.

Broadly stated, the invention is a process for producing a metallurgical coke from caking coal which comprises: artificially oxidizing the caking coal by heating it at a temperature less than about 350° C. in an oxygen-containing atmosphere for a period of time sufficient to oxidize part of the caking coal to at least the optimum level of oxidation required to produce a metallurgical coke when the coal is subsequently carbonized; and carbonizing the oxidized caking coal to produce metallurgical coke.

The invention further extends to two novel products. The first product is a caking coal which has been atificially oxidized and which, when carbonized, yields metallurgical coke. The second product is a caking coal blend comprising a first part of caking coal which has been artificially oxidized so that at least part of it is at that optimum level of oxidation required to yield metallurgical-grade coke on subsequent carbonization; and a second part of untreated caking coal; the ratio of oxidized coal to untreated coal being that ratio which will produce, on carbonization, a metallurgical coke.

DESCRIPTION OF THE DRAWINGS

FIG. 4 is a plot showing the dilatation and strengths of cokes derived from caking coal samples located at various depths throughout the oxidation set-up shown in FIG. 3.

DESCRIPTION OF THE PREFERRED EMBODIMENT

The process of the present invention is preferably a three step process to produce a metallurgical coke from a charge of caking coal.

Before dealing with the details of the process, it is worthwhile to clarify a number of terms used in context with the present invention.

A "metallurgical coke" refers to a coke resulting from a carbonization at high temperatures and is characterized by a stability factor of at least 50 as determined by ASTM procedures: D3038-72 and D294-64 (1972). Other properties such as high reactivity and low ash and sulphur content are also desirable in a metallurgical coke. For the purposes of this invention however a coke is considered to be a metallurgical coke if it satisfies the mechanical stability requirement.

"Caking coals" include bituminous coals having a high amount of volatile material and an elemental analysis typical of those given in Table 1. These are coals which exhibit on carbonization the properties of high swelling, high dilatation and high fluidity.

"Carbonization" refers to a high temperature (~1000° C.) thermal decomposition of coal to produce a metallurgical coke. This is distinct from "semi-carbonization" and "low temperature carbonization" which are processes to produce gas, char and tar at relatively low temperatures.

Turning to the process of the present invention, the preferred combination of three steps include oxidizing, blending and carbonizing a caking coal in order to produce a metallurgical coke.

The oxidation step includes heating the caking coal at a temperature of less than about 350° C., which is the decomposition temperature of most caking coals, in an oxygen containing atmosphere for a time sufficient to oxidize a substantial portion of the caking coal to at least an optimum level of oxidation. (The term "artificially oxidizing" is used in describing this process in the claims to distinguish from the level of oxidation which occurs naturally when the coal is exposed to outdoor atmosphere.) This optimum level of oxidation is defined as that degree of oxygen treatment producing an oxidized caking coal which on carbonization yields a metallurgical coke.

Figure 2:
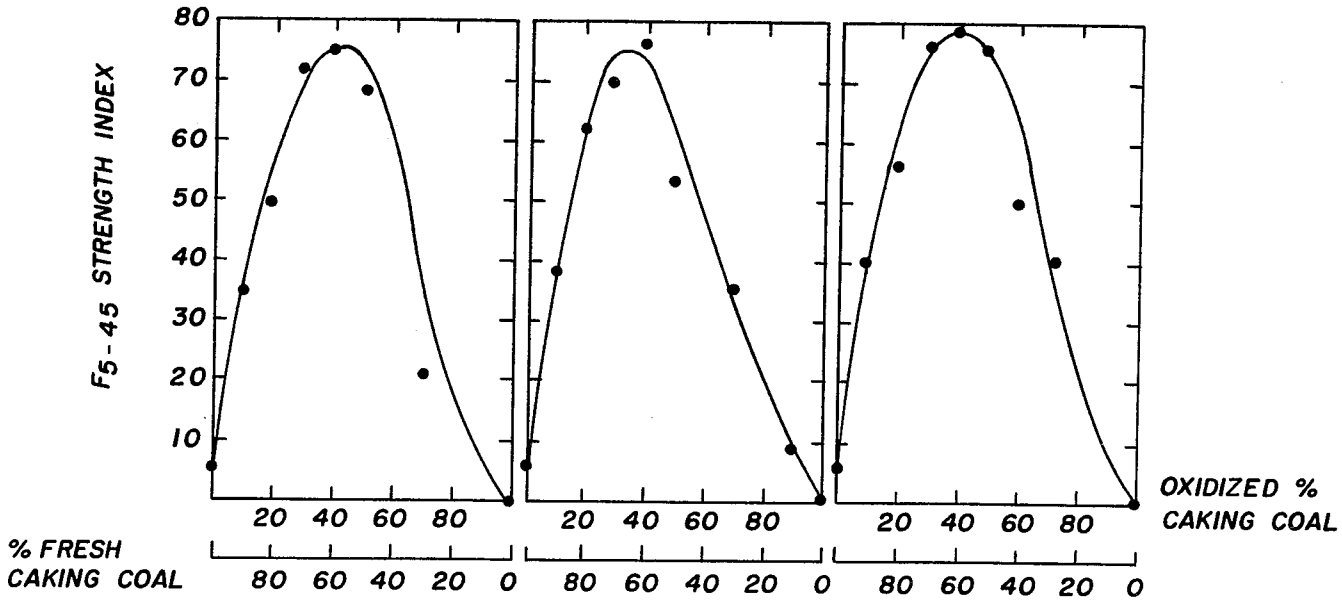
FIG. 2 is a plot showing the strengths of cokes derived from blends of oxidized and untreated caking coal, which blends have been subsequently carbonized.

An optimum level of oxidation may be better understood by referring to FIG. 2. An optimum level of oxidation in the coal precursor is represented by the portion of the curves coinciding with a coke strength index of at least 50.

Oxidation in context with the present invention refers to the chemical reaction and/or chemisorption of oxygen with the caking coal during the pre-oxidation step.

It will be evident to those skilled in the art that to produce a quantity of optimally oxidized caking coal in accordance with the process of the present invention, a number of oxidizing conditions can be used. The oxidation time will be dependent on such parameters as the pre-heating temperature and the concentration of oxygen in the atmosphere used. These interdependent parameters, which can be determined by routine experimentation, need not be critically monitored since, as will be demonstrated later, the average level of oxidation achieved in the caking coal preferably need only be at least at an optimum level of oxidation. Samples oxidized beyond this level may be produced and utilized in the process.

It may be possible to homogeneously oxidize a large quantity of caking coal to an optimum level of oxidation and subsequently carbonize the charge to produce a metallurgical coke. Although such cases fall within the scope of the present invention, it is usually not feasible to proceed in this manner. Preferably the caking coal is oxidized such that the average level of oxidation is at least at an optimum level of oxidation. This oxidized caking coal is then blended with a quantity of untreated or relatively non-oxidized caking coal. The quantity of untreated caking coal required in the blend is that quantity which when blended with the oxidized caking coal yields on carbonization a metallurgical coke. The ratios of oxidized and fresh caking coals needed are determined by testing the strengths of the cokes derived from a number of these blends.

The above blend of caking coals is charged into a coking oven and carbonized by a conventional procedure at a temperature of at least 1000° C. to yield a metallurgical coke. The coal blends may be hot or cold charged into the oven without affecting the quality of the coke. It is preferable to cold charge the coal in order to avoid the possibility of explosion of the hot coal fines.

The operability of the process, together with the optimum materials, procedures and conditions are established in the following examples.

EXAMPLE 1

In order to establish that the strength of a coke derived from a caking coal can be increased by an artificial oxidation treatment, the following experiment was performed.

Three types of high volatile bituminous caking coals (hvab), the characteristics and thermal rheological properties of which are summarized in Tables 1 and 2, were heated at 180±3° C. in an atmosphere of commercially available nitrogen (containing oxygen) in a reactor for varying periods of time. The flow rate of nitrogen through the reactor was adjusted to 10 ml/min.

Following the oxidation treatment the coal samples were each carbonized at temperatures of at least 1000° C. For the details of the carbonization procedure see Ignasiak, B., ad Berkowitz, N., CIM Bulletin, 67, No. 747,72, 1974.

After carbonization the strength index of each sample was obtained by the method set forth in the abovementioned reference to Ignasiak et al. These $F_{5-45}$ strength indices have been correlated with the ASTM stability factors in the same reference. For comparison purposes an $F_{5-45}$ strength index of 50 is approximately equal to an ASTM stability factor of 50. Since a metallurgical coke is characterized by an ASTM stability factor of at least 50, those cokes having an $F_{5-45}$ strength index greater than 50 would certainly be classified as a metallurgical coke.

Table 3 summarizes the strength indices of the preoxidized carbonized coke samples. For comparison purposes strengths are given for a coke derived from a caking coal sample which had not been oxidized prior to carbonization. Strengths are also given for a coke derived from the original coal sample which had been pre-heated under the same conditions but in an atmosphere of oxygen-free nitrogen.

TABLE 1

| | | Characteristics of Test Coals | | | | | | | | | |
|---|---|---|---|---|---|---|---|---|---|---|---|
| | | Proximate analysis (%) | | | | Calorific | | | | | |
| | | Moisture (capacity | Ash Dry | V.M. | Fixed Carbon | Value Gross | Ultimate analysis (%) (daf) | | | | |
| Coal | Rank | moist) | Basis | (daf) | (daf) | BTU/lb. | C | H | N | S | O* |
| 1 | hvab | 2.1 | 4.2 | 32.2 | 67.7 | 14,510 | 87.6 | 5.4 | 1.6 | 0.8 | 4.6 |
| 2 | hvab | 1.7 | 6.3 | 34.2 | 65.8 | 14,290 | 87.3 | 5.5 | 1.6 | 1.5 | 4.1 |
| 3 | hvab | 2.0 | 5.3 | 36.9 | 63.1 | 14,270 | 86.0 | 5.5 | 0.9 | 0.7 | 6.9 |

*by difference

TABLE 2

| Thermal Rheological Properties of Test Coals | | | | | | | | | | |
|---|---|---|---|---|---|---|---|---|---|---|
| | | (Gieseler) plasticity[1] | | | | Ruhr-dilatation[2] | | | | |
| Coal | FSI | Soft. temp. (°C.) | Max. fluid. temp. (°C.) | Solid. temp. (°C.) | Max. fluid. (dd/m) | Soft. temp. (°C.) | Max. contr. temp. (°C.) | Max. dilat. temp. (°C.) | Max. contr. (%) | Max. dilat. (%) |
| 1 | 8 | 403 | 455 | 491 | 3600 | 365 | 423 | 519 | 27 | 182 |
| 2 | 8 | 400 | 443 | 476 | 13100 | 355 | 401 | 611 | 23 | 394 |
| 3 | 8 | 400 | 443 | 475 | 8200 | 369 | 412 | 487 | 29 | 122 |

Note
[1]Gieseler plasticity was determined in accordance with ASTM procedure D2639-74
[2]Dilatometric properties were determined in a Ruhr dilatometer as described in DIN.

TABLE 3

| | | Strength Indices ($F_{5-45}$) | | |
|---|---|---|---|---|
| Coal | Oxidation Time | No Pre-treatment | Oxygen Pre-treatment | Oxygen-free Pre-treatment |
| hvab #1 | 120 hrs. | 5 | 52 | 5 |
| hvab #2 | 280 hrs. | 0 | 55 | 0 |
| hvab #3 | 72 hrs. | 6 | 43 | 6 |

The results show firstly that the oxygen pre-treatment of caking coals greatly improves the strength of the produced coke. Furthermore the same treatment in an oxygen-free atmosphere does not improve the mechanical properties of the coke. Thus the improvement in the quality of the coke produced results from oxidation and not water removal as was previously thought to be the case (e.g. see Beck, K.G., 25th Canadian Conference on Coal, Victoria, B.C., September, 1973).

EXAMPLE 2

The following example demonstrates that the operating conditions used in the oxygen pre-treatment step can be varied without significantly changing the mechanical stability of the resulting coke.

Three samples (~100g each) of the hvab #3 caking coal characterized in Example 1 were spread in trays in thin layers (<⅛ inch) and placed in an oven. Oxidation was carried out according to one of the following conditions:

A. oxidation in pure oxygen at 200° C.;
B. oxidation in air at 150° C.; or
C. oxidation in air at 100° C.

Figure 1:
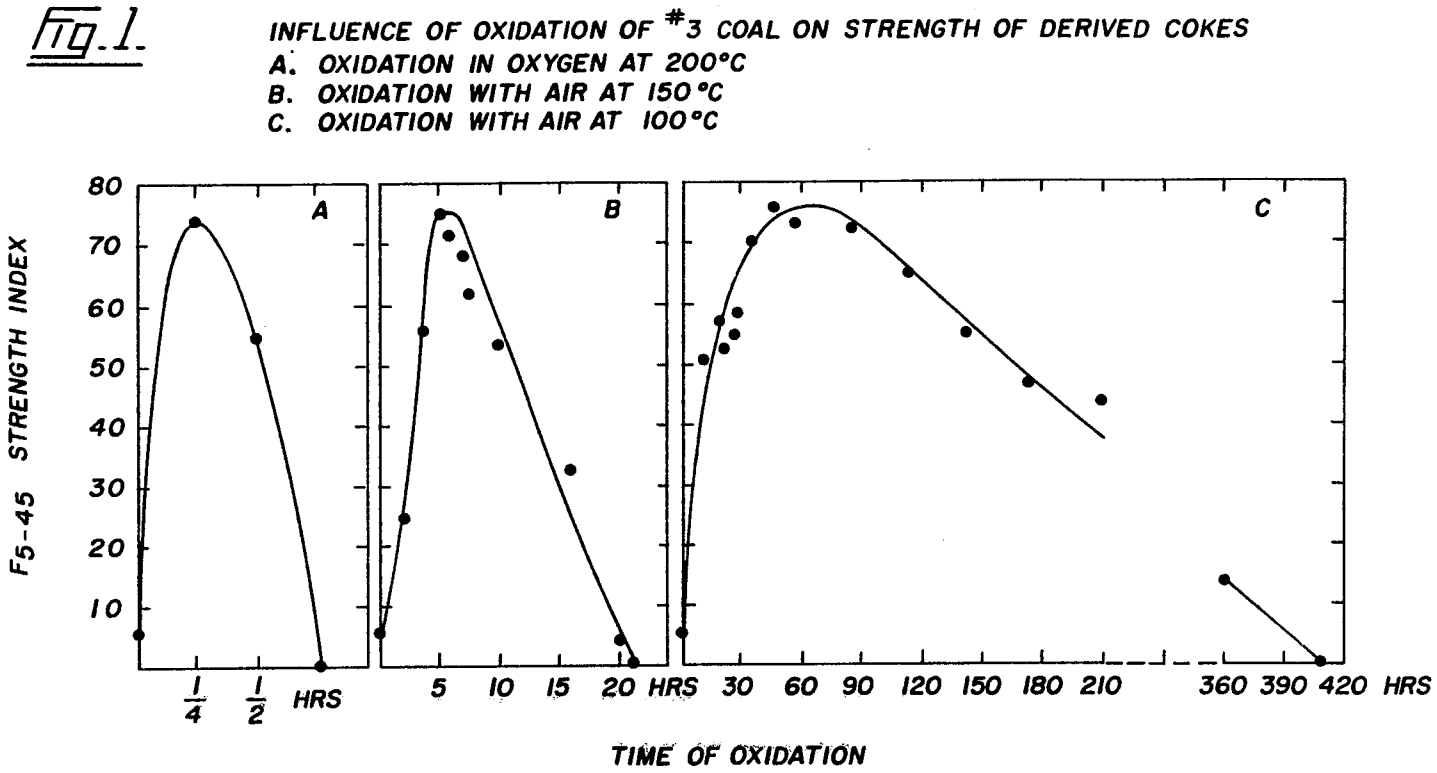
FIG. 1 is a plot showing the strength of oxidized caking coal samples which have been subsequently carbonized varying with changing oxidizing conditions.

The oxidizing gas was continuously passed through the oven at a flow rate of about 100 ml/min. Subsamples were periodically removed during the oxidation step and carbonized as per Example 1. The $F_{5-45}$ strength indices of the coke were measured and are shown in FIG. 1.

Referring to these results it can be seen that by the proper selection of the reaction conditions, that is the temperature of oxidation, time of oxidation and concentration of oxygen in the oxidizing gas, it is possible to reach an optimal level of oxidation in the caking coals. These optimally oxidized coals will produce on carbonization a metallurgical coke. This optimal level of oxidation in a given oxygen containing atmosphere at a given temperature corresponds to a time of oxidation which yields on carbonization a coke having a strength index of at least 50. In a pure oxygen atmosphere at 200° C. this optimal level of oxidiation is reached in a few seconds, whereas in air at 100° C. this level is reached after about 20 hours.

It should be noted that the results of both Examples 2 and 3 demonstrate that any concentration in the oxygen-containing gas, from a few ppm up to about 100% oxygen, is suitable for the pre-treatment step. Temperatures ranging from 100° C. to 200° C. did not influence the quality of coke obtained from an optimally oxidized coal. Therefore any temperature from ambient temperatures up to a few degrees below the temperature of thermal decomposition of the caking coal (~350° C.) appears suitable for the pre-oxidation step.

The time of oxidation is shown to be a function of the temperature and concentration of oxygen in the oxidizing atmosphere. It thus must be modified accordingly. By proper combination of the reaction parameters, the oxidation time can be shortened to a few seconds or if desired, extended to several days.

The toleration with respect to the above three operating parameters makes it clear that the oxidation step does not require specific and elaborate oxidizing equipment.

EXAMPLE 3

It will have been noted in the previous examples that as the treatment of the caking coals under the oxidative conditions is prolonged an oxidized coal results which on carbonization yields a progressively weaker coke, having strengths less than those required for a metallurgical coke. The following example demonstrates that a caking coal which has been oxidized to past a level of optimal oxidation can be mixed with a quantity of fresh or untreated caking coal to yield a blend which on carbonization will yield a high strength metallurgical coke.

Samples of the hvab #3 caking coal characterized in Example 1 were oxidized to complete loss of agglutinating properties by the procedures set forth in Example 2; that is, the oxidized coal on carbonization yielded a coke having a $F_{5-45}$ strength index of zero. This oxidized coal was blended in various ratios with fresh hvab #3 coal and the mixtures carbonized. The strength indices of the product coke were determined and are illustrated in FIG. 2.

It can be seen that by optimizing the ratios of the oxidized and fresh caking coals prime metallurgical coke may be produced.

EXAMPLE 4

In a large scale coking industry it would usually not be feasible to pre-oxidize large charges of caking coal to an optimal level of oxidation, since this would require a complex set-up under critical monitoring. The following example demonstrates that carbonization of a charge composed of portions of variously oxidized caking coal can also yield on carbonization a coke improved in strength.

Figure 3:
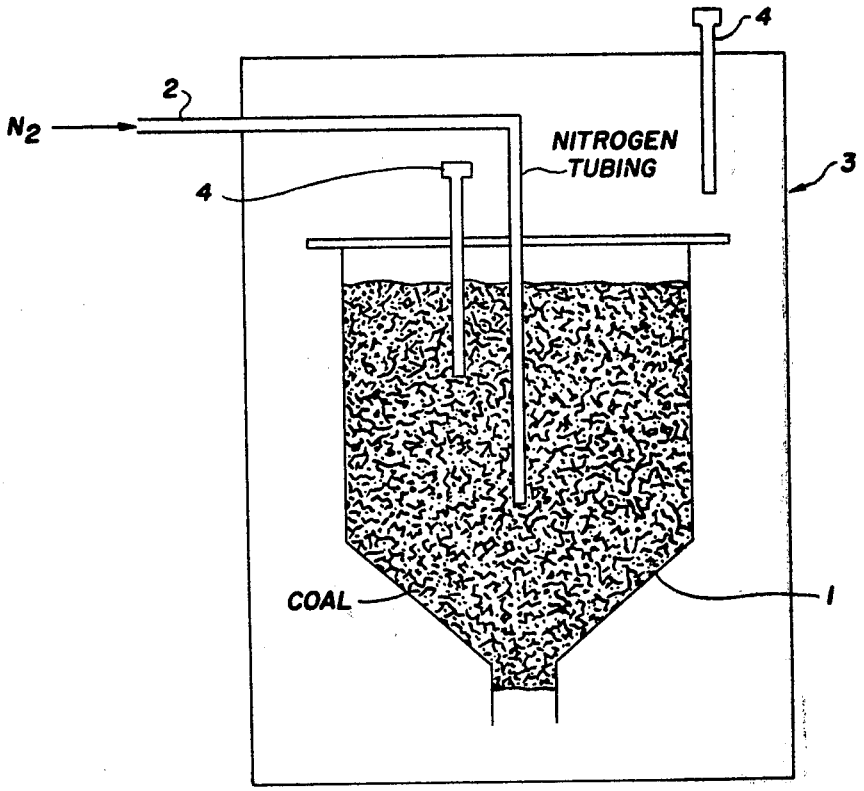
FIG. 3 is a schematic of the set-up used to artifically oxidize a large charge of caking coal.

A 500 lb. charge of the hvab #3 caking coal characterized in Example 1 was subjected to a mild oxidation pre-treatment in the hopper 1 depicted in FIG. 3. A steady flow of commercial grade nitrogen (900 ml/min) was admitted through inlet 2 into the hopper. The temperature of the hopper 1, as controlled and measured by gas heated oven 3 and thermocouples 4 respectively, was increased gradually to 90° C. after two days, to 120° C. after three days, and to 170° C. after four days.

On completion of the oxidation step, samples of the oxidized coal from different locations in the hopper were cooled rapidly at −10° C. in a nitrogen atmosphere and subjected to dilatometric analysis. The strength indices were estimated from these analysis. The results, as depicted in FIG. 4, show that the oxidation of the charge was not uniform throughout the hopper.

Nevertheless, when, after identical oxidizing treatments, the entire charge was either immediately carbonized (hot charged) or cooled down in nitrogen then exposed for a few days to the atmosphere and subsequently carbonized (cold charged), an impressive improvement in coke strength was observed. The results are summarized in Table 4. The quality of the coke was not affected by hot or cold charging. Thus it would not only be acceptable, but even recommended to avoid hot charging, thereby eliminating the risk of explosions of hot desiccative coal fines.

TABLE 4

Evaluations of Cokes Produced in a 500 p Moveable-Wall Coke Oven from Fresh and Oxidized #3 Coal

| | ASTM Stability Factor (%) | Hardness Factor (%)[1] | Breeze[2] |
|---|---|---|---|
| 1. fresh coal | 35.2 | 64.5 | 3.9 |
| 2. oxidized in a hopper for 96 hrs. (hot charging) | 45.8 | 64.5 | 3.6 |
| 3. oxidized in a hopper for 96 hrs. (cold charging) | 47.1 | 64.3 | 3.5 |

Notes
[1]Hardness Factor describes the cumulative percentage remaining on a ¼ in. sieve, as determined by ASTM D294-64, 1972
[2]Breeze describes the percentage of the coke between the limits of ½ in. and 1 in.

The coke produced subsequent to the oxidative pre-treatment, as compared to the coke produced from untreated caking coal, is characterized by an unchanged hardness factor and a lower breeze content. These results show that other qualities of the coke have not been adversely affected by the oxidative pre-treatment. In fact, the breeze factor can be improved by this process.

The results of Examples 3 and 4 demonstrate that, provided there is a sufficient quantity of caking coal at least at a level of optimal oxidation, it does not matter whether the charge consists of homogeneously oxidized coal or is prepared by blending components at different levels of oxidation. An improved strength coke results from either of these cases.

While the present invention has been described in terms of a number of illustrative embodiments, it should not be so limited, since many variations in the process will be apparent to persons skilled in the related art without departing from the true spirit and scope of the invention.

Similarly, while it has been proposed that the benefits resulting from the process can be explained by oxidation of the caking coal, the present invention should not be restricted to any particular explanation of the mechanism responsible for the benefits achieved through the use of the process.

The embodiments of the invention in which an exclusive property or privilege is claimed are defined as follows:

1. A process for producing a metallurgical coke from caking coal which comprises:

artificially oxidizing the caking coal by heating it at a temperature less than about 350° C. in an oxygen-containing atmosphere for a period of time sufficient to oxidize part of the caking coal to a level of oxidation which will produce a metallurgical coke when the coal is subsequently carbonized; and carbonizing the oxidized caking coal to produce metallurgical coke.

2. A caking coal which has been artificially oxidized and which when carbonized, yields metallurgical coke.

3. A process for producing a metallurgical coke from caking coal which comprises:

(a) artificially oxidizing a first part of caking coal by heating it at a temperature less than 350° C. in an oxygen-containing atmosphere to oxidize at least part of the coal;

(b) blending the product from step (a) with untreated caking coal; and (c) carbonizing the blend to yield metallurgical coke.

4. A caking coal blend comprising:

a first part of caking coal which has been artificially oxidized so that at least part of it is at a level of oxidation required to yield a metallurgical grade coke on subsequent carbonization; and a second part of untreated caking coal, the oxidized coal and untreated coal being included in a weight ratio which will produce, on carbonization of the blend of coal, a metallurgical coke.

* * * * *